United States Patent [19]

Hazelton

[11] 3,935,884

[45] Feb. 3, 1976

[54] COLUMN PACKING DEVICE

[75] Inventor: Heath Robin Hazelton, Orpington, England

[73] Assignee: Burroughs Wellcome Co., Research Triangle Park, N.C.

[22] Filed: May 23, 1974

[21] Appl. No.: 472,667

[52] U.S. Cl. ..... 141/80; 259/72

[51] Int. Cl.[2] ..... B65B 1/22

[58] Field of Search ..... 141/34, 12, 71–81; 259/72; 74/56, 57, 50; 173/114

[56] References Cited

UNITED STATES PATENTS 3,838,716 10/1974 Ripple et al. ..... 141/77

*Primary Examiner*—Houston S. Bell, Jr.

*Attorney, Agent, or Firm*—Donald Brown

[57] ABSTRACT

A chromatographic column packing device comprising a drive plate for receiving column locating means, driving means slidably coupled to said drive plate through a drive shaft, cam following means carried by said drive plate cooperating with a supported climb-face cam, a rotatory member mounted on said drive shaft, a contact arm carried by said rotatory member and positioned for intermittent impact with a cooperating member mounted on a shaft supporting tappers, said tappers being resiliently biassed relative to a column, whereby a column may simultaneously be submitted to a vertical reciprocating motion combined with lateral vibration together with rotation.

The device is particularly suitable for packing high pressure liquid chromatographic columns.

14 Claims, 3 Drawing Figures

COLUMN PACKING DEVICE

The present invention relates to a chromatography column packing device and in particular to a device for packing particulate support material within a high pressure liquid chromatography column.

It is already known that vertical bouncing and horizontal tapping of the column during the addition of the support material is recommended for the reproducible dry packing of chromatography columns. It has further been suggested that addition of the support material in a slow continuous stream with rotation of the column together with lateral tapping near the packing surface assist the uniformity of the packing and hence the reproducibility of the results obtained using such columns.

A simple column packing device has now been developed in which a high pressure liquid chromatography column may automatically be submitted to a vertical reciprocating motion combined with lateral vibration together with rotation, whilst the required amount of support material is added in a slow continuous stream. As used herein and throughout the specification the term "reciprocating" denotes a repeated motion comprising a slow lift and a sudden drop. The device may, furthermore, be applicable to the packing of columns for gas liquid chromatography.

According to the present invention there is provided a chromatographic column packing device which comprises a drive plate for receiving column locating means, which is slidably coupled through a drive-shaft to driving means and which carries cam following means cooperating with a supported climb-face cam, and a rotatory member mounted on the drive shaft and having a contact arm positioned for intermittent impact with a cooperating member on a shaft supporting tappers resiliently biassed relative to a column.

The column locating means comprises a unit having a collar at one end for receiving the column, which is secured by a nut and ferrule, and a threaded projection at the other end for fitting into the recessed drive plate. The unit is provided with a stainless steel grid to retain the support material in the column whilst allowing the passage of liquid. The plate is connected to the driving means, for example a motor, through a sliding coupling which advantageously consists of a sleeve depending from the plate and having a longitudinal slot for cooperating with a peg mounted on an extension of the drive shaft, which is slidably located within the sleeve. The cam following means comprises a member, preferably cylindrical, projecting radially from the side of the plate and may conveniently be a roller bearing.

The rotatory member, for instance a wheel, may advantageously carry more than one, and preferably five, contact arms extending radially around its circumference for intermittent and sequential impact with the cooperating member, which comprises an actuating arm coupled to the tapper shaft. The column tappers are biassed against the column by a spring interconnecting a fixed point on the cam support with the tapper shaft and are biassed away from and towards the column as the actuating arm respectively engages and disengages with the contact arm(s).

Although the height of the climb-face cam, the number of contact arms and the speed of the motor can be appropriately selected to achieve any desired degree of agitation of the column, for efficient packing of the column it is convenient to have a cam height of 2 cm, a motor speed of 60 rev/min and five control arms, producing a vibration of 300 taps/min. Furthermore whilst the device is especially suitable for packing columns of length 0.5 m and external diameter 6 mm, it may readily be adapted for use with straight columns of other dimensions.

An embodiment of the invention will now be described with reference to the accompanying drawings in which FIG. 1 is a part-sectional side elevation of the packing device showing a column in position, but omitting the column locating means;

Figure 1:
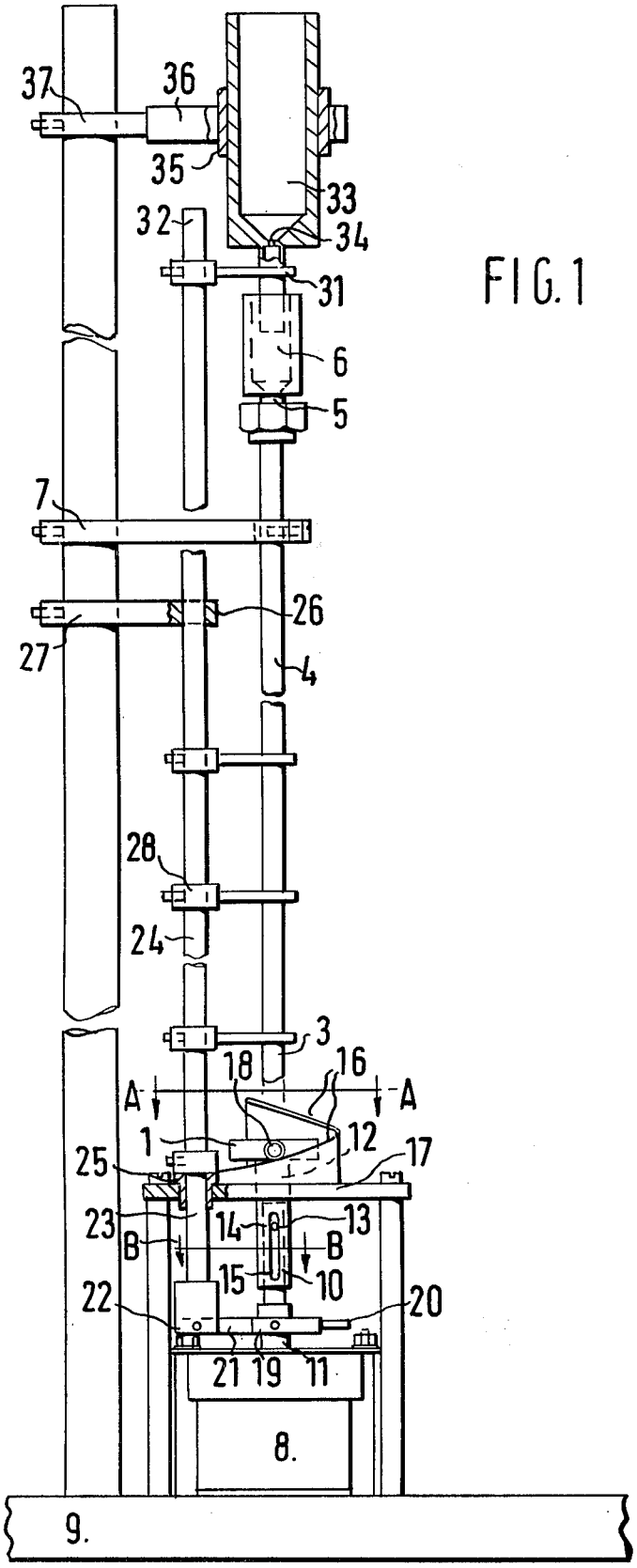
Figure 2:
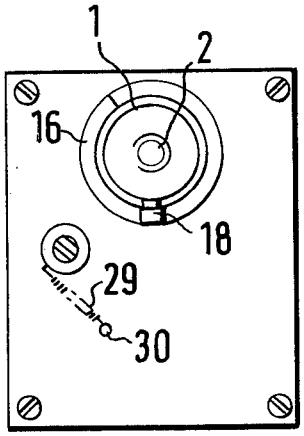
FIG. 2 is a section along the line A—A of FIG. 1.

Referring to the Figures the device comprises a column drive plate 1 provided centrally with a threaded recess 2 for receiving a standard Perkin-Elmer column locating unit (not shown) fitting one end 3 of a commercial 0.5 m × 6 mm external diameter high pressure liquid chromatography column 4. The other end 5 of the colum 4 is connected to a Perkin-Elmer packing funnel 6 having a cylindrical inner surface, which assists introduction of the support material (not shown) into the column 4. The column 4 is supported adjacent the funnel 6 by an adjustable clamp 7 which permits free rotation and vertical movement of the column 4.

The plate 1 is connected to a Crouzet type 832 motor 8, seated on a heavy duty retort stand 9 acting as the main support for the column 4, through a sliding coupling 10 between an extension 14 rigidly attached to the motor drive shaft 11 and a sleeve 12 depending from the plate 1. The sleeve 12 is provided with a longitudinal 2½cm slot 15 which slides relative to a peg 13 located radially upon extension 14. A 270° helical climb-face cam 16 of height 2 cm is mounted on a table 17 supported by stand 9 and a polytetrafluoroethylene roller bearing cam follower 18 extending radially from the plate 1 follows the profile of the cam 16 through the sliding coupling 10.

Figure 3:
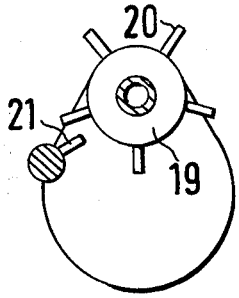
FIG. 3 is a section along the line B—B of FIG. 1.

A capstan wheel 19 having five cylindrical arms 20 radially disposed therefrom regularly around its circumference, as shown in FIG. 3, is mounted on the drive shaft 11 for intermittent impact with an actuating arm 21 rigidly fixed by a cylindrical coupling member 22 to one end 23 of a tapper shaft 24. The tapper shaft 24 is supported in first and second polytetrafluoroethylene bearings 25 and 26, mounted respectively on the table 17 and an adjustable support 27 mounted on the stand 9. Five rod-shaped column tappers 28 attached at regular intervals along the length of the tapper shaft 24 are adjustable both vertically and horizontally to effect even tapping throughout the length of the column 4. The tappers 28 are biassed against the column 4 by an extension spring 29 interconnecting the coupling member 22 to a fixed point 30 on the table 17. An additional tapper 31 adjacent the end 32 of the tapper shaft 24 remote from the motor 8 is positioned to vibrate an aluminium support material reservoir 33, including an outlet orifice 34 of 0.5 mm diameter bore, contained in a rubber sleeve 35 held in a Terry clip 36 mounted on an adjustable reservoir clamp 37 on the stand 9.

In operation of the column packing device the plate 1 is rotated at the speed of the motor 8 (60 rev/min) through the sliding coupling 10 and is simultaneously vertically reciprocated following the profile of the cam face (height 2 cm) at each rotation. As the wheel 19 is turned by the motor 8 one of the contact arms 20 engages with the actuating arm 21 every one-fifth of a second, such that the tappers 28 are thereby momentarily biassed away from the column 4 by the extension spring 29. After disengagement with the actuating arm 21 the force of the spring 29 returns the tappers 28 to their rest position whereby a tap is made on the surface of the column 4 300 times a minute.

The following example illustrates the operation of the device, but is in no way intended to limit the scope of the invention.

EXAMPLE

A standard high pressure liquid chromatography 0.5 m column, external diameter 6 mm, internal diameter 2.6 mm fitted with a column locating unit and a packing funnel was mounted in the device. Perkin-Elmer Sil-X support material (2g) having a particle diameter of 37–44 $\mu$m was poured into a reservoir provided with a 0.5 mm bore outlet. The reservoir was positioned with its lower end within the packing funnel and the motor immediately started. After 15 minutes the reservoir had emptied and 5 minutes later the device was stopped and the column removed. The column contained 1.45g of support material, the remainder having been retained in the funnel.

The device is especially suitable for packing columns with support material of particle diameter 25 to 50$\mu$m. The outlet bore of the reservoir must be such that a slow, continuous stream of support material issues into the column over a convenient length of time, and in practice a bore of 0.5 to 1 mm has been found to produce the desired stream in about 20 to 30 minutes.

I claim:

1. A chromatographic column packing device comprising a column drive plate, driving means slidably coupled to said drive plate for rotating said drive plate through a drive shaft, cam following means carried by said drive plate cooperating with a supported climb-face cam, a rotatory member mounted on said drive shaft, a contact arm carried by said rotatory member and positioned for intermittent impact with a cooperating member mounted on a shaft supporting tappers, said tappers being resiliently biassed relative to a column, whereby said drive plate may simultaneously be submitted to a vertical reciprocating motion while said shaft supporting said tappers may be intermittently rotated by said contact arm.

2. A device as claimed in claim 1, in which said drive shaft or an extension thereof is slidably located within and cooperates with a sleeve depending from said drive plate.

3. A device as claimed in claim 2, in which said sleeve includes means defining a longitudinal slot for cooperating with a peg mounted on said drive shaft or an extension thereof.

4. A device as claimed in claim 1, in which the cam following means comprises a member projecting radially from a side of said drive plate.

5. A device as claimed in claim 4, in which the cam following means comprises a roller bearing.

6. A device as claimed in claim 1, in which the rotatory member carries at least two contact arms extending radially around its circumference for intermittent and sequential impact with said cooperating member.

7. A device as claimed in claim 6, in which the rotatory member carries five contact arms regularly spaced around its circumference.

8. A device as claimed in claim 1, in which the cooperating member comprises an actuating arm coupled to said shaft supporting tappers.

9. A device as claimed in claim 8, in which said tappers are biassed away from and towards a column, received by said column locating means, as said actuating arm respectively engages and disengages with said contact arm.

10. A device as claimed in claim 1, in which the tappers are biassed against a column by a spring interconnecting a fixed point on a cam support with said shaft supporting the tappers.

11. A device as claimed in claim 1, in which a recess is provided in said drive plate.

12. A device as claim in claim 11, in which the recess is threaded.

13. In a chromatographic column packing machine which includes means for supporting a chromatographic column for rotating and vertical motion, the improvement of a chromatographic column drive plate, drive means for vertically moving and rotating said drive plate in order to rotate and vertically move the chromatographic column, and tapper means comprising a tapper shaft mounted for rotation and supporting a tapper member for impacting against said column, and means for intermittently rotating said tapper shaft in a first direction less than a complete revolution and thereafter releasing said tapper shaft to permit it to rotate in a direction opposite to said first direction.

14. In the machine of claim 13 in which means is provided for causing said tapper shaft to rotate in said direction opposite to said first direction.

* * * * *